US005168804A

United States Patent [19]

Lee et al.

[11] Patent Number: 5,168,804

[45] Date of Patent: Dec. 8, 1992

[54] POSTAGE METER HAVING AN AUTOMATIC SLOGAN SUB-MODULE

[75] Inventors: David K. Lee, Monroe; Richard A. Sloan, Jr., Oxford, both of Conn.

[73] Assignee: Pitney Bowes Inc., Stamford, Conn.

[21] Appl. No.: 812,441

[22] Filed: Dec. 23, 1991

[51] Int. Cl.[5] ..... B41J 1/32

[52] U.S. Cl. ..... 101/99; 101/93; 101/93.21; 101/93.26

[58] Field of Search ..... 101/93.18, 93.19, 93.21; 101/93.26, 93.35, 94.45, 91, 93, 99, 106, 110

[56] References Cited

U.S. PATENT DOCUMENTS

| | | | |
|---|---|---|---|
| 3,504,622 | 3/1970 | Morrison | 101/99 |
| 4,122,770 | 10/1978 | Umeda et al. | 101/99 X |
| 4,380,195 | 4/1983 | Hori et al. | 101/99 X |
| 4,852,482 | 8/1989 | Storace | 101/110 |

*Primary Examiner*—Edgar S. Burr
*Assistant Examiner*—Christopher A. Bennett
*Attorney, Agent, or Firm*—Charles G. Parks, Jr.; Melvin J. Scolnick

[57] ABSTRACT

A printing mechanism sub-module for postage meters of the flat-bed type includes a meter housing with a print meter slogan aperture. A first and second print element each includes a plurality of radially locatable print faces around the center of the respective print elements. A first and second brackets is mounted to the internal of the meter housing and a shaft is rotatively mounted between the first and second brackets having a first and second shaft section. The first printing element is mounted radially around the first shaft section such rotation of the shaft causing corresponding rotation of the first printing element. The second printing element is rotatively mounted around the second shaft section such that the second printing element may be rotatively positioned independently of the shaft position. A first gear fixably mounted around the shaft. A second print element has a second gear formed at one end and aligned opposite the first gear. A solenoid selectively acts on the first gear and second to rotate the associated print element.

3 Claims, 5 Drawing Sheets

POSTAGE METER HAVING AN AUTOMATIC SLOGAN SUB-MODULE

BACKGROUND OF THE INVENTION

The present invention relates to a postage meter and, more particularly, to such postage meter mailing machine combinations of the flat-bed type wherein the postage meter is suitably adapted to print a slogan and optionally a postage class indicia.

It is known to provide a postage meter with the ability to print an ad slogan or postage class indicia. It is also known to provide the postage meter with the capability to print an operator selected one of a plurality of ad slogans along the postage indicia. However, it is customary for such postage meters to require the operator to manually manipulate a meter mechanism in order to position the desired ad slogan in proper print position.

In a new postage meter mailing machine combination, it has been determined beneficial to provide a postage meter cartridge which is insertable into a receptacle of the mailing machine. It has also been determined beneficial to mount the postage meter under a positionable cover. In order to improve the human friendliness of the new postage meter mailing machine combination, it has been determined as beneficial to provide the combination the ability to print one of a plurality of ad slogans where the ad slogan mechanism can be automatically positioned in the proper print position to print the desired ad slogan.

It has further been determined to provide the combination the ability to print along with the postages imprint and optional ad slogan, the mail class, e.g., first class or presorted.

SUMMARY OF THE INVENTION

It is an object of the present invention to present an automatic print module particularly suited for incorporation in a postage meter of the flat-bed type or similar printing mechanism for automatically positioning one of a plurality of ad slogan indicia in a print position.

It is a further objective of the present invention to present an automatic print module particularly suited for incorporation in a postage meter of the flat-bed type or similar printing mechanism for automatically positioning one of a plurality of mail class indicia in a print position.

It is still a further objective of the present invention to present an automatic print module particularly suited for incorporation in a postage meter of the flat-bed type or similar printing mechanism for automatically positioning, in combination, one of a plurality of ad slogan indicia and one of a plurality of mail class indicia in print position.

The postage meter cartridge includes a housing having a meter base plate. The print registration area of the meter base plate has a formed generally rectangularly shaped aperture. The printing mechanism sub-module is mounted within the meter such that the printing plates of the sub-module can be positioned in the aperture to enable print by the respective printing plates of the printing mechanism. The printing mechanism in the preferred embodiment includes first and second print elements or cubes, each of the print elements having a plurality of radially locatable print faces around the center of said respective print elements. A shaft having a first and second shaft section rotatively supports the shaft such that the first and second print cubes may be independently and selectively rotated to position a respective print face within said print meter slogan aperture. The first printing cube is fixably mounted radially around the first shaft section such that rotation of the shaft causes corresponding rotation of the first printing cube. The second printing cube is rotatively mounted around the second shaft section such that the second printing cube may be rotatively positioned independently of the shaft position. A respective ratchet gear train actuated by a solenoid positionable along a rail to the respective ratchet gear train acts upon the gear train to cause displacement of the respective print cube. It is noted that any suitable postage template for a respective country or territory may be adhered to the indicia plate using any suitable conventional method, such as, by an adhesive bonding agent.

DETAILED DESCRIPTION OF THE PREFERRED EMBODIMENT

Figure 1:
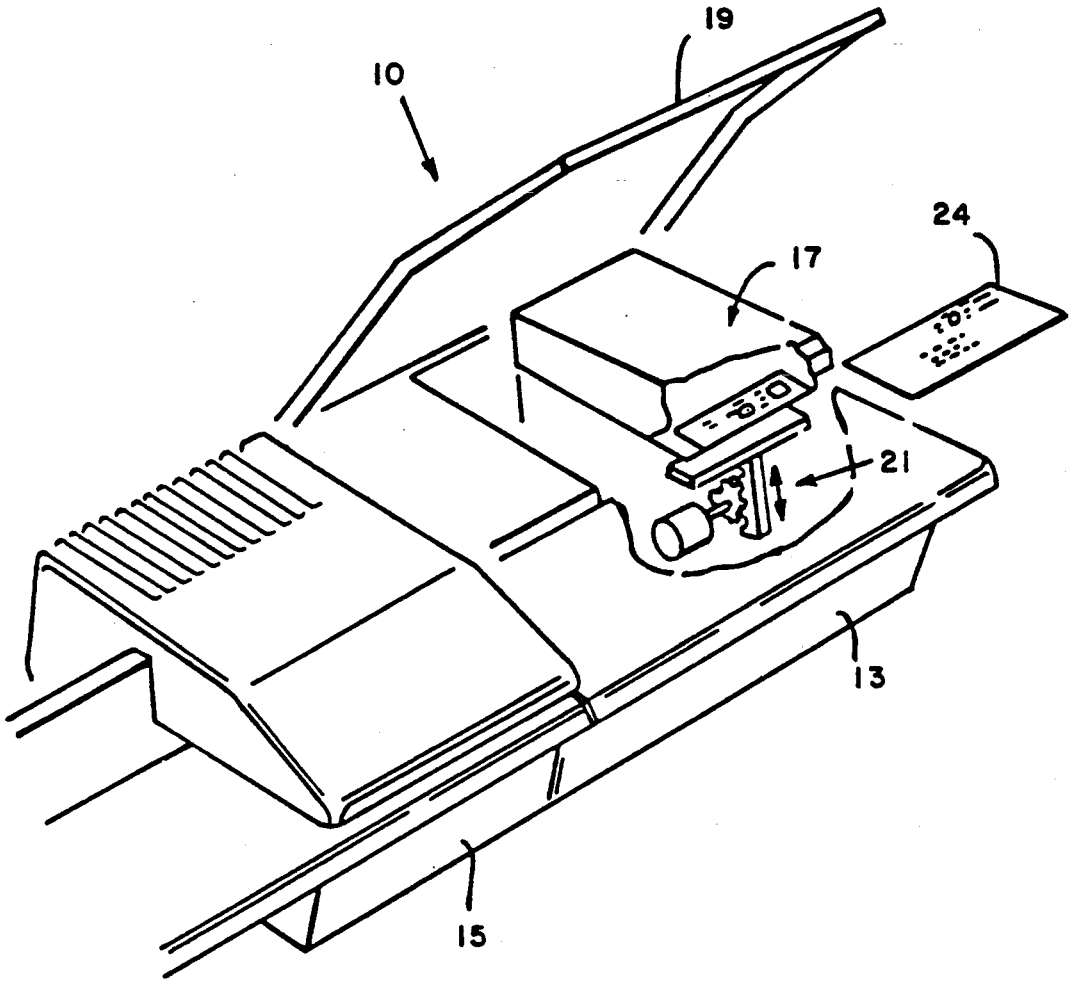
FIG. 1 is a perspective view of a postage meter mailing machine combination in accordance with the present invention.

Referring to FIG. 1, a high speed mail processing system, generally indicated as 10, has been developed of the flat-bed printing type. The mail processing system is generally described here includes a mailing machine base unit, generally indicated as 13, and a feeder section, generally indicated as 15. A postage meter cartridge is insertable into the mailing machine base unit 13 upon pivotal displacement of the mailing machine hood 19. Also, mounted in the base unit 13 is a platen assembly. In the most preferred embodiment of the mail processing system 10, the mailing machine base unit 13 additionally includes an integrated scale, microcontroller and operator interface system, not particularly described here.

Generally, in operation, envelopes 24 are supplied from the feeder unit 15 in a seriatim manner to the deck of the mailing machine base unit 13 to be positioned particularly below the meter cartridge's 17 print area. Actuation of the platen mechanism 21 causes the respective envelope 24 positioned below the meter cartridge 17 print area to be printed with a postage indicia and, in the same operation at the option of the operator, with other information such as carrier mail class and an ad slogan. A more detailed description of the operation of the mail processing system 10 is presented in U.S. Pat. Nos. 4,876,956 and 4,924,804, herein incorporated by reference.

Figure 2:
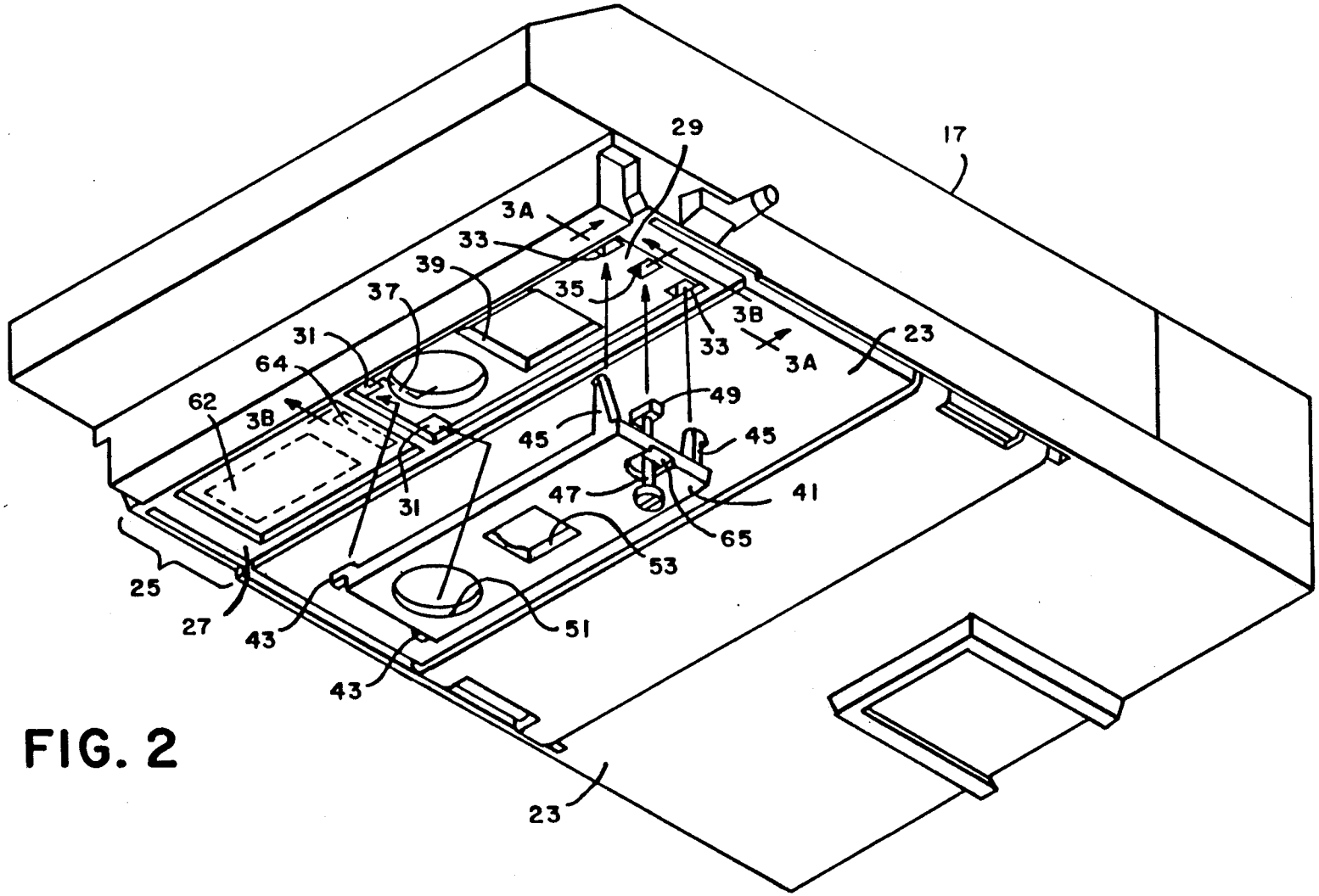
FIG. 2 is a perspective view of a postage meter cartridge insertable into a suited mailing machine in accordance with the present invention.

Referring more particularly to FIG. 2, the postage meter 17 is viewed in a perspective orientation to more clearly reveal the underside of meter base plate 23. The print registration area 25 of the meter base plate 23 includes a first rectangular shaped aperture 27 and a second rectangular shaped recess 29. Within the recess 29 are located first mounting apertures 31, second mounting apertures 33, locking aperture 35, dater aperture 37, and value and wheel aperture 39. It should be appreciated that the dater and value wheel apertures 37 and 39, respectively, are provided to permit exposure of a suitable dater and postage value print wheel mechanism during the postage printing cycle of the mail processing system.

To provide for the postage indicia embossing, a detachable indicia plate 41 is provided. As here described, the preferred embodiment includes a detachable indicia plate which allows retrofitting of a respective meter 17 with an appropriate indicia plate for the respective country of residency. Additionally advantageous, by replacing the indicia plate 41, a mailing system may be easily relocated from one country to another for area specific national or territorial operation. Here briefly described, the indicia plate 41 includes generally horizontal mounting tabs 43 aligned to be angularly received in respective mounting apertures 31 and upon angular positioning of the indicia plate 41 secured against the inner surface of the base plate 23. Generally vertical mounting tabs 45 formed on the indicia plate 41 are aligned to be received in the respective apertures 33. A locking pin 47 has a block member 49 which extends through an aperture in the indicia plate.

When the indicia plate 41 is positioned within the recess 29, rotation of the locking pin 47 is caused to travel through the aperture 35 such that the block member 49 is allowed to pass through the aperture 35 only in a particular orientation. After the indicia plate is positioned in the recess 29, the locking pin 47 is reoriented such that the block member 49 prevents the locking pin 47 from being removed. The locking plate 41 further includes a dater aperture 51 and a value aperture 53 which aligns to the apertures 37 and 39, respectively. It is noted that any suitable postage template for a respective country or territory may be adhered to the indicia plate using any suitable conventional method, such as, by an adhesive bonding agent.

Figure 3:
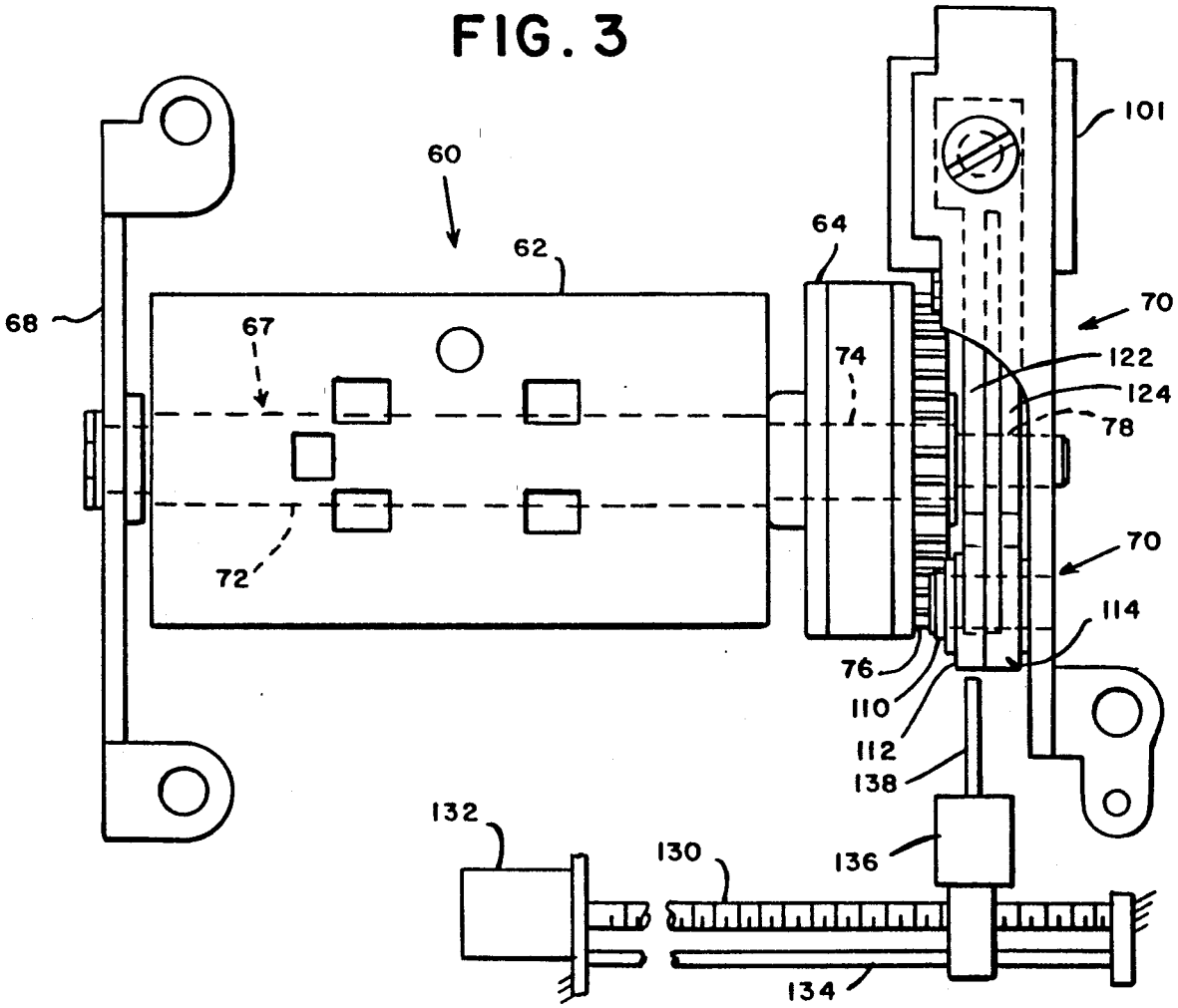
FIG. 3 is a top view of an ad slogan and mail class sub-module in accordance with the present invention.
Figure 4:
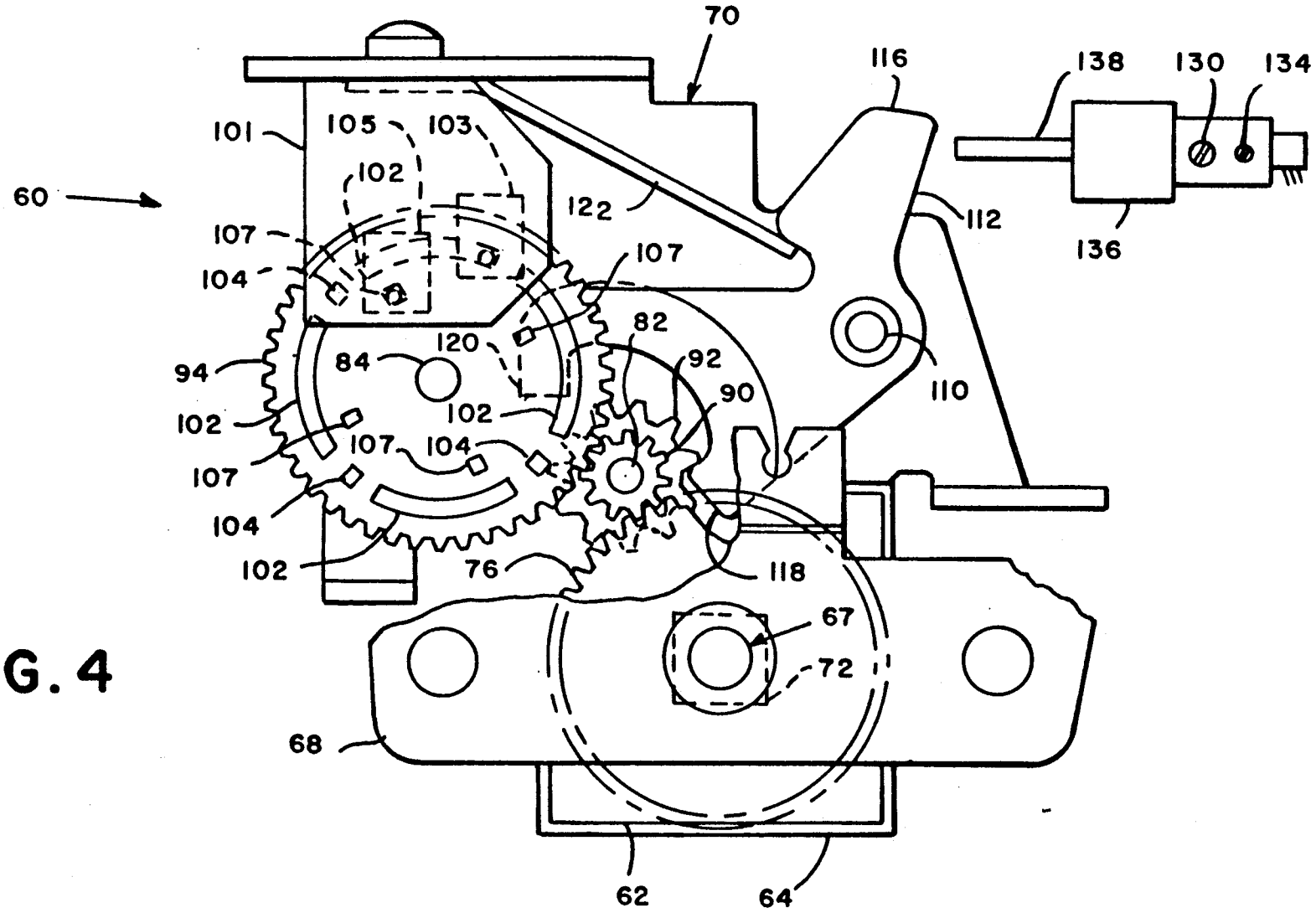
FIG. 4 is a side view of the ad slogan and mail class sub-module in accordance with the present invention.
Figure 5:
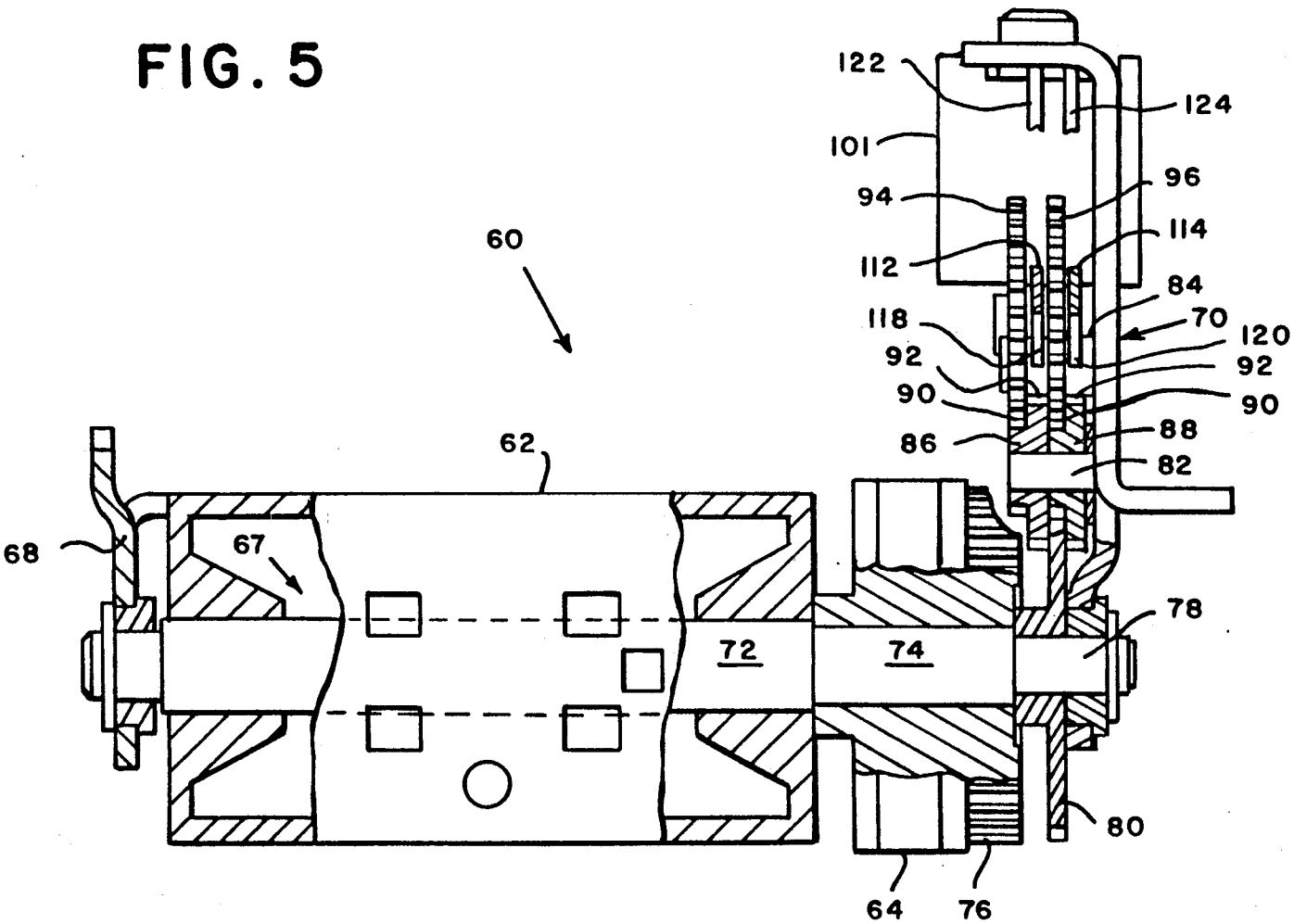
FIG. 5 is a front sectioned view of the ad slogan and mail class sub-module in accordance with the present invention.

Referring now to FIGS. 3, 4 and 5, fixably mounted within the meter cartridge 17 is a print mechanism, generally indicated as 60. The print mechanism 60 includes a slogan mounting cube 62 and postage class mounting cube 64 suitably mounted to a multi-section shaft 67. The shaft 67 is pivotally mounted at its respective ends by any conventional means to a first mounting bracket 68 and second mounting bracket 70. The brackets 68 and 70 are fixably mounted to by base plate 23 by any suitable means such as by screws.

Describing the elements along the shaft from left to right as viewed in the figures and representing the preferred embodiment of the invention, the shaft 67 has formed therealong a slogan shaft section 72 which has the slogan mounting cube 62 fixably mounted radially therearound by any conventional means such as by causing the shaft section 72 to have a rectangular radial cross section matting to a longitudinally extending aperture in the slogan mounting cube 62. The shaft 67 has formed subsequently therealong a postage class shaft section which has the postage class mounting cube 64 rotatively mounted therearound by any conventional means. The class mounting cube 64 has a formed gear 76. Subsequently formed therealong the shaft 67 is a drive section 78. A gear 80 is fixably mounted radially to the shaft drive section 78. It should now be appreciated that rotation of the gear 80 causes the shaft 66 to rotate and thereby rotatively position the slogan mounting cube 62 and that rotation of the class gear 76 directly repositions the class mounting cube on the shaft 67.

Best viewed in FIG. 5, the bracket 70 includes a first short shaft 82 and a second short shaft 84. Rotatively mounted around the first short shaft 82 are first gear hub 86 and second gear hub 88. The gear hubs 86 and 88 are identically constructed and respectively comprise a formed first gear 90 and star gear 92. The gear 90 of the first gear hub 86 is in constant mesh with the gear 76 of the class mounting cube 64 and the gear 90 of the second gear hub 88 is in constant mesh with the gear 80. Rotatively mounted by any conventional means to the short shaft 84 are identical wheel gears 94 and 96, respectively. The gear 90 of the first gear hub 86 is in constant mesh with the wheel gear 94 and the gear 90 of the second gear hub 88 is in constant mesh with the wheel gear 96.

As best viewed in FIGS. 3 and 4, an optical sensor bracket 101 is fixably mounted to the bracket 70. The optical sensor bracket 101 maintains a conventional first and second optical sensor pairs wherein the emitter and detector of each optical sensor is maintained in spaced apart alignment. The wheel gears 94 and 96, respectively, are aligned that a corresponding portion of the wheel gears 94 and 96, respectively, is positioned to pass through a portion of the optical sensor bracket 101 during rotation of the respective wheel gear 94 and 96. Each wheel radial portion aligned to journey through the optical sensor bracket 101 includes a plurality of alternating and radially aligned slots 102 and apertures 107 and a plurality of radially aligned apertures 104 arranged and aligned in such a manner that the response output of the first optical pair 103 and the second optical pair 105 is relatable to the position of the respective wheel gears 94 and 96 by conventional techniques employing, for example, by the microcontroller of the mail processing system. Again, using convention techniques, the position of the wheel gears 94 and 96 is respectively relatable to the class mounting cube 74 and the slogan mounting cube 72. Preferably, the sensor pair 103 and related slots 102 and apertures 107 are designed to detect the home positions of the wheel 94 and 96 and also 90 degree rotations. The sensor pair 105 and related apertures 104 are designed to detect whether or not the printing surfaces of the slogan mounting cube 62 and the class mounting cube 64, respectively, are flat, not angled, to print.

A short shaft 110 is formed on the mounting bracket 70 and includes a first ratchet lever 112 and a second ratchet lever 114 rotatively mounted on the short shaft 110 by any conventional means. Each ratchet lever 112 and 114, respectively, includes a ratchet plate 116 having a first push arm 118 and second push arm 120. The push arms 118 and 120 of the respective ratchet levers 112 and 114 are aligned to interact with the star gear 92 of respective gear hubs 86 and 88 in a manner subsequently described. One end of a first leaf spring 122 is fixably mounted to the mounting bracket 70 and, in like manner, a second leaf spring 124 is fixably mounted to the mounting bracket of 70 at one end. The leaf springs 122 and 124, respectively, are positioned to the mounting bracket 70 such that the other end of each leaf spring is biased against respective ratchet levers 112 and 114, in a first position to be biased in a star tooth of respective star gears 90 and 92, respectively.

Referring more particularly to FIGS. 2, 3 and 4, in operation, a threaded track 130 rotatively driven by a motor 132 is rotatively mounted within the meter 17 by any conventional means. A guide rod 134 is also mounted within the meter 17. Threadably mounted to the track 130 and riding on the guide rod 134 is a single acting solenoid 136 having a solenoid arm 138. The solenoid 136 is positioned such that actuation of the motor 132 aligns the solenoid arm 138 opposite either the ratchet plate 116 of ratchet arm 112 or 114, respectively. When the solenoid arm 138 is aligned opposite the ratchet plate 116 of ratchet arm 112, actuation of the solenoid 136 to pivot to a first position. This action brings the ratchet push arm 120 into displacing contact with a star tooth of the star gear 92 of gear hub 82 to cause a half action of the star gear 92. The return stroke of the solenoid 136 disengaged contact between the solenoid arm 138, thereby allowing the biasing action of the spring 122 against the ratchet lever 112 to cause the ratchet arm 118 of ratchet gear 112 to come into advancing contact with another star tooth of the star gear 92. Resultantly, a single ratchet step is complete and subsequently displacing the gear 90 of the gear hub 86. Repeated action of the solenoid 136 causes rotational displacement of the gear 90 of the gear hub 86.

As the gear 90 of the gear hub 86 is in constant mesh with both gear 94 and the formed gear 76, rotation of the gear hub 86, in the manner described, causes rotational displacement to both the postage class 64 and the gear 94 in an algorithmic manner. In like manner, alignment and actuation of the solenoid 136 to the ratchet lever 114 causes rotation of the shaft 72 through gear 80 and, thereby, rotation displacement of the ad cube 62 in an algorithmic manner. It is now apparent that the response patterns of the optical sensor par 103 and 104 can ascertain the position of the ad slogan cube and the mail class cube to the microcontroller to align operator selected cube faces in the aperture 27 for printing by positioning and actuating the solenoid 136.

The above description has set forth the most preferred embodiment of the present invention and should be considered as limiting. The scope of the present invention is defined by the appendix claims hereto.

What is claimed is:

1. In an improved printing mechanism for postage meters of the flat-bed type having a meter housing with a print meter slogan aperture, wherein said improvement comprises:

a first and second print elements, each of said print elements having a plurality of radially locatable print faces around the center of said respective print elements;

support means for supporting said first and second print cubes within said meter housing such that said first and second print cubes may be independently and selectively rotated to position a respective print face within said print meter slogan aperture;

a shaft having a first and second shaft section, said first printing cube being fixably mounted radially around said shaft section such that rotation of said shaft causes corresponding rotation of said first printing cube, and, said second printing cube being rotatably mounted around said second shaft section such that said second printing cube may be rotatably positioned independently of said shaft position;

positioning means for selectively rotating said first print cube to any of a plurality of radial positions and for selectively rotating said second print cube to any of a plurality of radial positions, said positioning means having a first gear fixably mounted around said shaft, a second gear being rotatably mounted around said shaft and fixably mounted to said second printing cube such that rotation of said second gear causes rotation of said printing cube, and rotation means for selectively causing said first gear and second to rotate said rotation means having said support means having a bracket, first intermediate gear being rotatively mounted to said bracket and having a formed primary gear and formed star gear, said primary gear being in constant mesh with said first gear, second intermediate gear being rotatively mounted to said bracket and having formed primary gear and formed star gear, said primary gear being in constant mesh with said second gear, first ratchet lever pivotally mounted to said bracket having ratchet arms which can be alternated into contact with said star gear of said first intermediate gear, second ratchet lever pivotally mounted to said bracket having ratchet arms in alternating communication with said star gear of said second intermediate gear, and means for causing said first ratchet lever to pivotally displace and thereby cause said ratchet arms of said first ratchet lever to alternatively register in said star gear of said first intermediate gear to cause said first intermediate gear rotatably ratchet and for causing said second ratchet lever to pivotally displace and thereby cause said ratchet arms of said second ratchet lever to alternatively register in said star gear of said second intermediate gear to cause said second intermediate gear to rotatively ratchet.

2. In an improved printing mechanism for postage meters of the flat-bed type having a meter housing with a print meter slogan aperture, wherein said improvement comprises:

a first and second print elements, each of said print elements having a plurality of radially locatable print faces around the center of said respective print elements;

first and second brackets fixably mounted to the internal of said meter housing, a shaft rotatably mounted between said first and second brackets having a first and second shaft section, said first printing cube being fixably mounted radially around said first shaft section such rotation of said shaft causing corresponding rotation of said first printing cube;

said second printing cube being rotatively mounted around said second shaft section such that said second printing cube may be rotatively positioned independently of said shaft position;

a first gear fixably mounted around said shaft;

said second print cube having a second gear formed at one end and aligned opposite said first gear; and rotation means for selectively causing said first gear and second to rotate, said rotating means having said support means having a second bracket, first intermediate gear being rotatably mounted to said second bracket and having formed primary gear and formed star gear, said primary gear being in constant mesh with said first gear, second intermediate gear being rotatably mounted to said second bracket and having formed primary gear and formed star gear, said primary gear being in constant mesh with said second gear, first ratchet lever pivotally mounted to said second bracket having ratchet arms which can be alternated into contact with said star gear of said first intermediate gear second retched lever pivotally mounted to said second bracket having ratchet arms in alternating communication with said star gear of said second intermediate gear, and means for causing said first ratchet lever to pivotally displace and thereby cause said ratchet arms of said first ratchet lever to alternatively register in said star gear of said first intermediate gear to cause said first intermediate gear rotatively ratchet and for causing said second ratchet lever to pivotally displace and thereby cause said ratchet arms of said second ratchet lever to alternatively register in said star gear of said second intermediate gear to cause said second intermediate gear to rotatively ratchet.

3. An improved printing mechanism as claimed in claim 2 further comprising encoding means for position encoding said first and second print cubes.

* * * * *